US006454121B1

(12) United States Patent
Kurtz et al.

(10) Patent No.: US 6,454,121 B1
(45) Date of Patent: Sep. 24, 2002

(54) DRAIN PAN FOR VEHICLE AXLE

(75) Inventors: Scotty R. Kurtz; Kevin L. Tally, both of Clarinda, IA (US); Steven D. Bauer, West Fargo, ND (US)

(73) Assignee: Lisle Corporation, Clarinda, IA (US)

( * ) Notice: Subject to any disclaimer, the term of this patent is extended or adjusted under 35 U.S.C. 154(b) by 63 days.

(21) Appl. No.: 09/697,548

(22) Filed: Oct. 26, 2000

(51) Int. Cl.[7] ..... B65D 1/34
(52) U.S. Cl. ..... 220/573; 220/571
(58) Field of Search ..... 220/573, 571

(56) References Cited

U.S. PATENT DOCUMENTS 2,496,684 A * 2/1950 Upchurch ..... 4/654
4,418,829 A * 12/1983 Clay ..... 220/657
4,673,081 A * 6/1987 Habig et al. ..... 206/223
4,930,602 A * 6/1990 Gust ..... 184/106
5,067,530 A * 11/1991 Short, III ..... 141/98
5,503,294 A * 4/1996 Taylor et al. ..... 220/571
5,706,873 A * 1/1998 Benoit et al. ..... 141/98

* cited by examiner

*Primary Examiner*—Mickey Yu
*Assistant Examiner*—Troy Arnold
(74) *Attorney, Agent, or Firm*—Banner & Witcoff, Ltd.

(57) ABSTRACT

A drain pan for collection of fluid from the wheel bearing housing of a vehicle includes spaced lateral sides connected by connecting sides shaped to fit on the rim of the vehicle. The connecting side has upper ends which serve the dual function of providing a storage tray as well as providing a hand grip.

13 Claims, 3 Drawing Sheets

FIG. 6
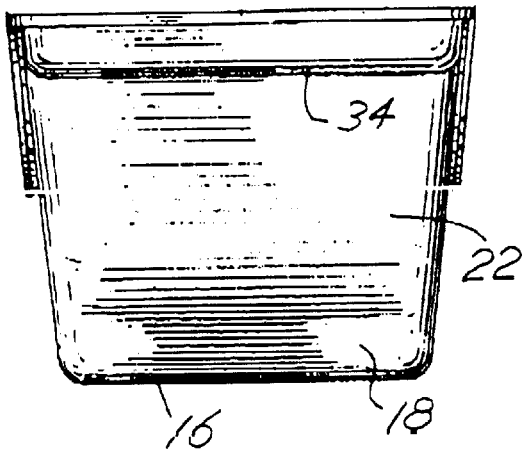
FIG. 7
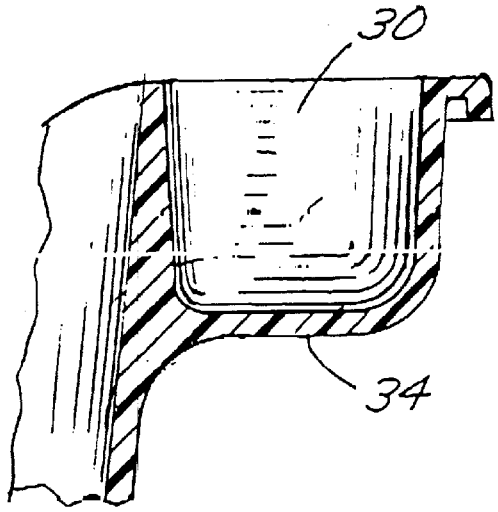
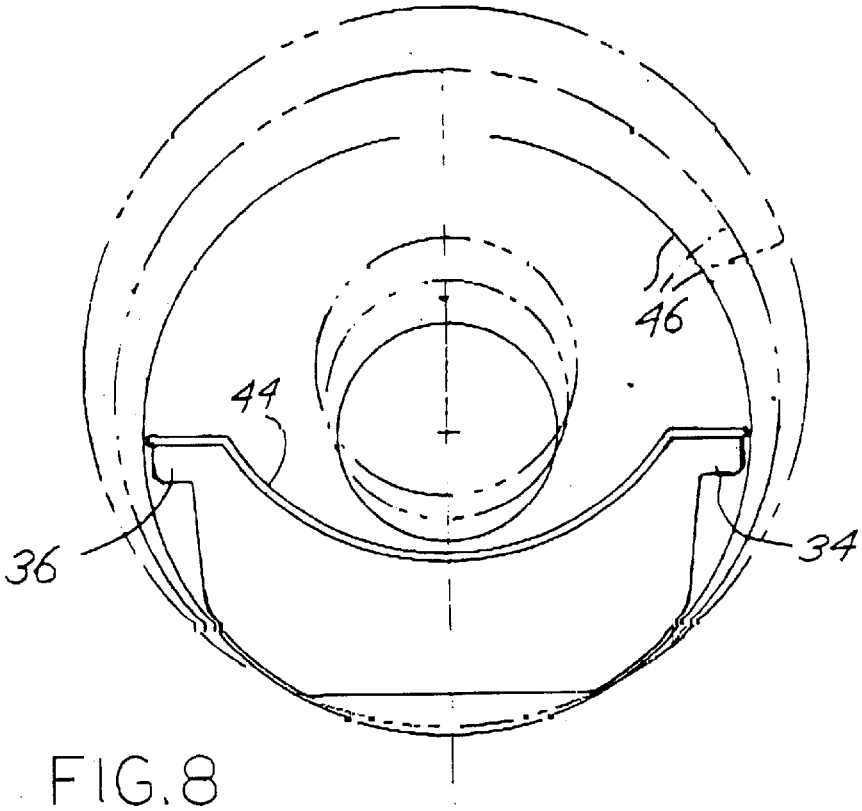
FIG. 8

DRAIN PAN FOR VEHICLE AXLE

BACKGROUND OF THE INVENTION

In the principal aspect, the present invention relates to a drain pan which is used to collect oil that is drained from the hub and axle of a vehicle such as a large over-the-road truck.

Modern trucks and other vehicles typically lubricate the wheel bearings with oil. The wheel bearings are immersed in oil to provide smooth and effective operation of the wheel rim which is mounted on the axle. Such wheels are mounted on rims that are affixed to the axle. The bearings are retained within an axle hub or housing and are immersed in oil.

Periodically it is necessary to drain the oil from the wheel bearing housing for replacement of seals, cam bushings, axles, hubs, spiders and hub caps. Merely removing the oil cap from the bearing housing will typically result in spillage of oil as it drains from the hub or housing. This poses an environmental hazard as well as a potential violation of legal requirements associated with recycling and proper collection of used vehicle fluids such as oil.

It has been proposed that an oil pan be placed on the horizontal flange associated with the rim of a wheel, and that the pan then be positioned under the hub of the axle in a manner which will enable collection of oil as it drains from the hub. Alternatively, another technique calls for placement of absorbent rags or other absorbent materials on the tire rim which become soaked with the oil, then collected and recycled.

These solutions are generally acceptable. Utilization of an oil pan appears, however, to be the most desirable solution to the problem. The design and construction of an appropriate oil pan which will have universal application for wheels and rims of multiple sizes, which can be easily transported, stored and utilized in many situations, and which is easy to position on the rim of a vehicle wheel has been identified as a design goal.

SUMMARY OF THE INVENTION

In a principle aspect the invention comprises a pan for collection of fluid from the wheel bearing housing or hub of a vehicle. The pan is formed with a flat bottom surface and arcuate sides which enable the pan to be easily positioned on a circular wheel rim. The pan further includes outwardly extended hand grips at its upper ends which, in a preferred embodiment, also comprise trays for placement of nuts or other items associated with the axle, wheel or rim. The pan further includes spaced, lateral sides joined by a connecting side. The connecting side defines the flat bottom and arcuate side elements required for effective placement and retention of the pan on the rim of a vehicle. The lateral sides have an arcuate top edge or margin to facilitate positioning of the pan on the vehicle rim so that the pan will not interfere with the hub or access to the hub of the vehicle. A circumferential rim is formed in the pan to enhance its structural integrity and further, the lateral sides of the pan have a draft angle to enable the pan to be easily stored or nested with other pans. In a preferred embodiment the pan is manufactured from a polymeric material such as polypropylene.

Further, such pans may be easily transported because of the side hand grips which also function as part trays. Because of the flat bottom of the pan, the pan may be placed on the floor without fear of tipping, spillage and loss of its contents while at the same time the connecting arcuate sides ensure the pan will remain in proper position when placed on the circular flange of a rim beneath a hub which is to be drained.

Thus it is an object of the invention to provide an improved drain pan for a vehicle wheel bearing housing.

It is a further object of the invention to provide a drain pan for a vehicle which may be easily moved or transported and which will hold accessory parts associated with the hub of an axle.

It is a further object of the invention to make a pan for collection of fluid from the axle and hub of a vehicle wherein the pan is fabricated from a molded plastic material which is inexpensive, rugged, lightweight and easy to use.

These and other objects, advantages and features of the invention will be set forth in the detailed description which follows.

BRIEF DESCRIPTION OF THE DRAWING

In the detailed description which follows reference will be made to the drawing comprised of the following figures:

FIG. 6 is an end-view of the pan of FIG. 3;

FIG. 7 is an enlarged cross-sectional view of the handle and tray section of the pan of FIG. 5;

FIG. 8 is a diagrammatic view illustrating the positioning of the pan of the invention on the rim of a vehicle wherein alternative rim sizes are indicated in phantom.

DESCRIPTION OF THE PREFERRED EMBODIMENT

Figure 1:
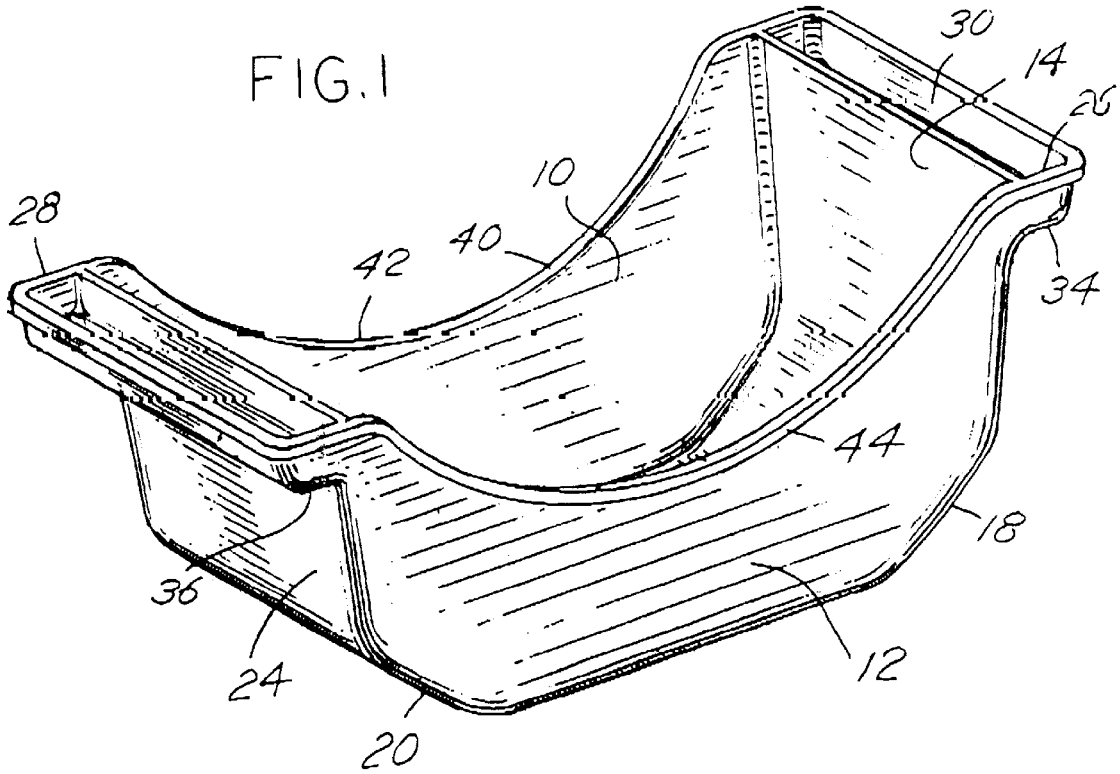
FIG. 1 is an isometric view of the pan of the invention.
Figure 2:
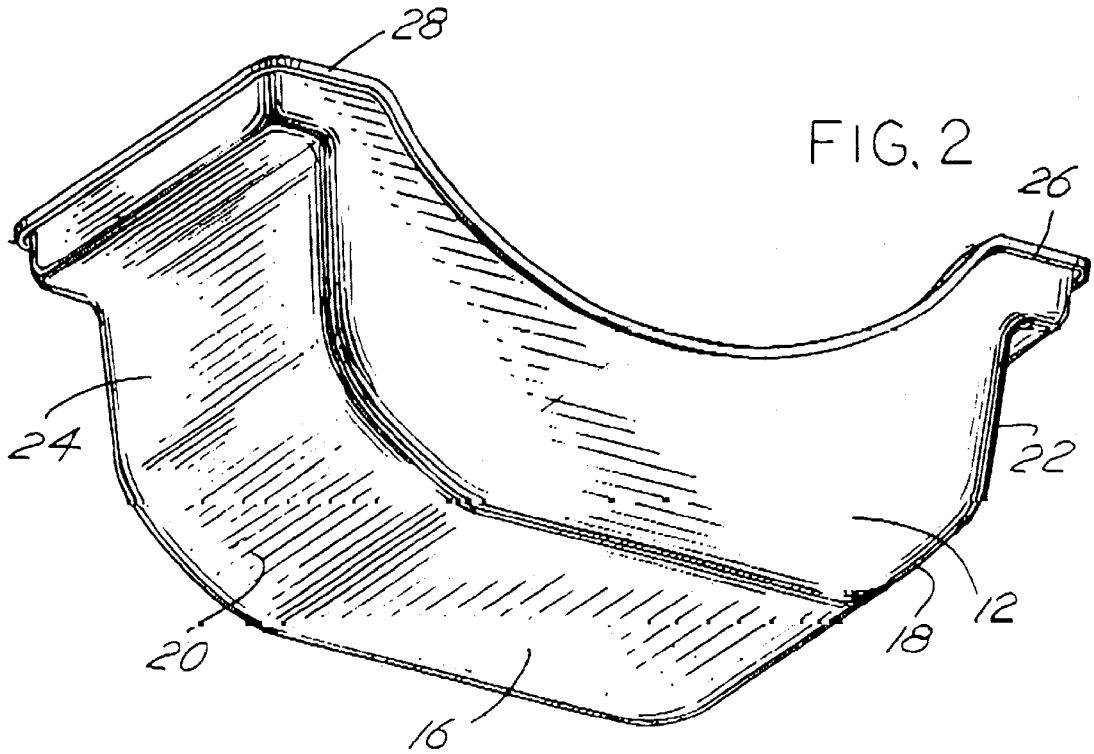
FIG. 2 is an isometric view of the pan of FIG. 1 as viewed from the underside thereof.
Figure 3:
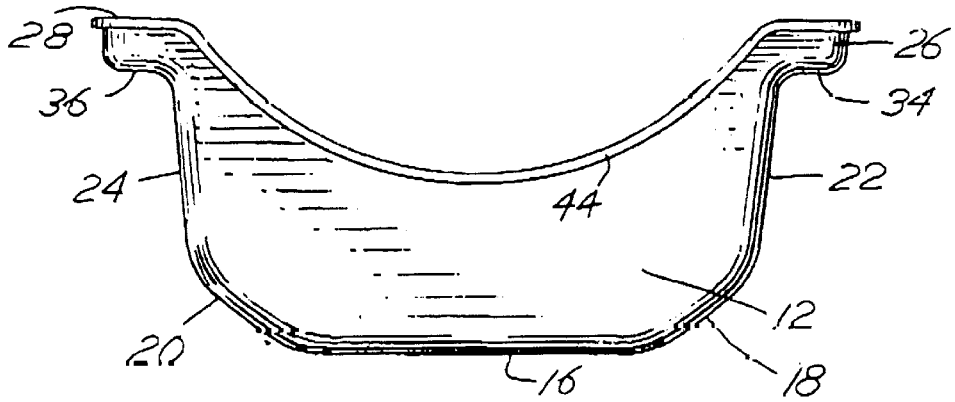
FIG. 3 is a side elevation of the view of the pan of FIG. 1.
Figure 4:
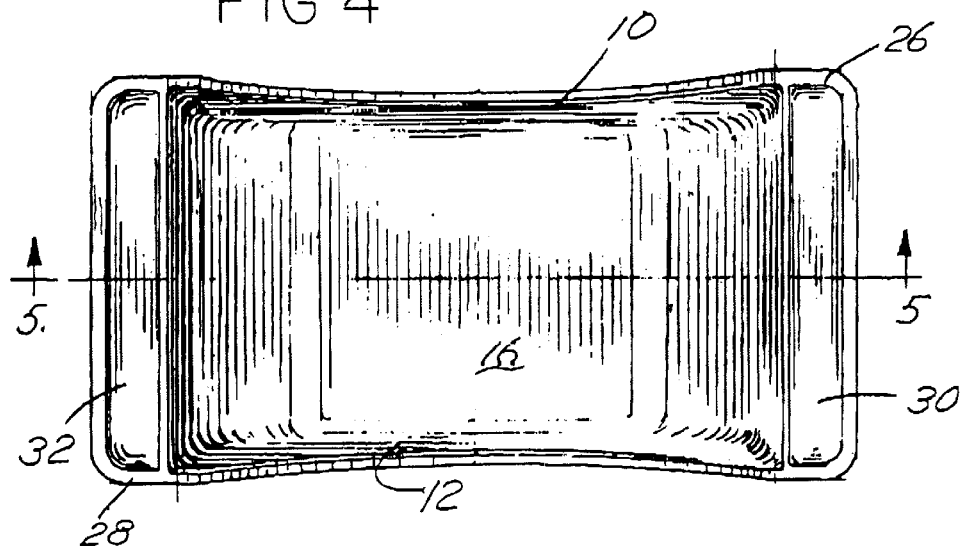
FIG. 4 is a top plan view of the pan of FIG. 1.
Figure 5:
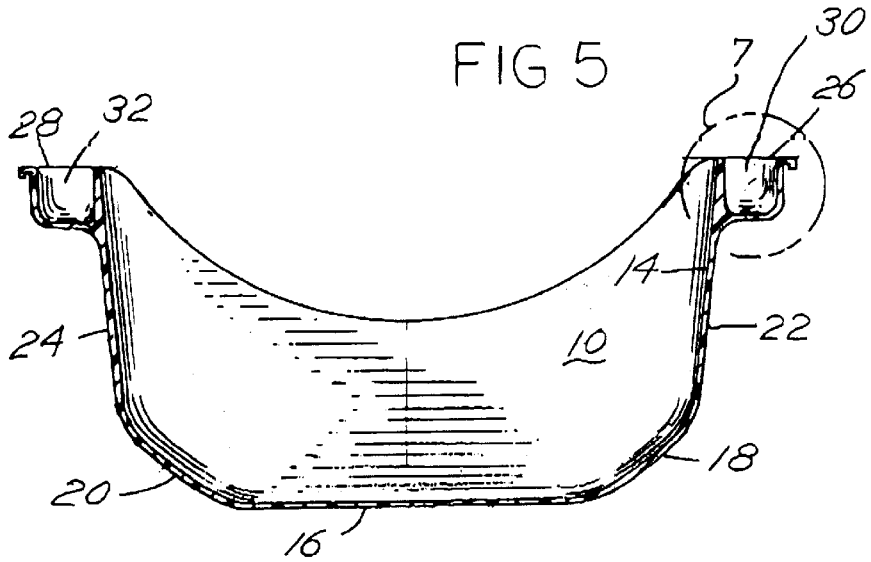
FIG. 5 is a cross-sectional view of the pan of FIG. 4 taken along the line 5—5.

The drain pan of the invention is preferably manufactured as a molded product from a polymeric material such as polypropylene. Referring to the figures, the molded drain pan includes a first lateral side 10 and a spaced second lateral side 12 which is generally parallel to and spaced from the first lateral side 10. A connecting side 14 is integrally molded with and connects the lateral sides 10 and 12. The lateral sides 10 and 12 are formed at a draft angle or are canted inwardly from the top to the bottom of the pan to permit stacking and nesting of drain pans of the type depicted in the figures. Each lateral side 10 and 12 is substantially identical in terms of its configuration. Thus the sides 10 and 12 are generally congruent one with respect to the other.

The connecting side 14 includes a flat bottom side 16, a first arcuate side section 18 and a second arcuate side section 20. The side sections 18 and 20 extend from the opposite ends of the bottom section 16. The arcuate side sections 18 and 20 connect smoothly to flat, opposite, end panels 22 and 24. The end panels 22 and 24 extend upwardly from arcuate side sections 18, 20 to form the upper ends of the connecting side 14; namely, mainly connecting ends 26 and 28. The configuration and shape of the connecting ends 26 and 28 is such that the ends 26 and 28 each define a tray 30 and 32 as well as a hand grip extension 34 and 36. That is, the upper ends 26 and 28 extend outwardly and, in combination with the inner side of the connecting wall 14, define cavities or trays 30 and 32. The cavities 30 and 32 provide receptacles for lug nuts, for example, associated with the hub of a vehicle wheel. The upper ends 26 and 28 thus serve the dual function of providing a storage tray or well 30 and 32 as well as a hand grip section 34 and 36.

The spaced lateral side walls 10 and 12 include a peripheral rim 40 which extends about the entire periphery of the pan to enhance its rigidity. Each side wall 10 and 12 also includes an arcuate to edge or margin 42 and 44 to facilitate placement of the pan underneath the axle and hub on the rim of a vehicle.

The functionality of the various component parts provides an important series of features for the invention. For example, the flat bottom 16 permits the drain pan to be placed on the floor for storage either when full or empty. The arcuate side sections 18 and 20 ensure that the pan will fit and be useful in combination with vehicle rims of various size depending upon the vehicle which is being serviced. For example, as shown in FIG. 8 there is depicted schematically the interior flat horizontal flange of a rim of a small one-ton truck having a five inch hub. The circular pattern 46 of the rim associated with that hub is such that the drain pan will fit within that circle. The other phantom circles depicted in FIG. 8 are representative of various hub and wheel sizes associated with other standard trucks in the industry. It is noted that the arcuate side sections 18 and 20 are configured so that the drain pan will easily fit and be balanced on the rim of all such vehicles regardless of the size thereof. The hand grip sections 34 and 36 are easily accessible in all circumstances. The upper edge or rim of each lateral side 10 and 12 is configured so that it will not interfere with the vehicle hub regardless of the size of the vehicle rim. The trays 30 and 32 are easily accessible for storage of lug nuts for example.

It is possible to vary the size, arrangement and construction of the various elements comprising the drain pan of the invention. For example, the radius of the arcuate side sections 18 and 20 may be varied though as depicted in figured 8 it is preferred that the radius be associated with the smallest size hub and wheel rim. The inclusion of one or two cavities or storage trays in the gripping handles 34 and 36 is optional. The particular configuration of the lateral sides 10 and 12 is also variable depending upon requirements. For example, the lateral sides 10 and 12 need not necessarily be congruent in shape. Thus the invention is to be limited only by the following claims and equivalents thereof.

What is claimed is:

1. A pan for collection of fluid from the axle and hub of a vehicle said hub having a circular rim with a circumferential, substantially horizontal flange, said pan comprising, in combination:

a first lateral side, a second lateral side spaced from the first side;

wherein at least one lateral side has an arcuate upper side margin;

a flat bottom side having first and second spaced ends;

first at least partially arcuate side section extending from a first spaced end of the bottom side to an upper end and connecting the lateral sides to form a pan enclosure;

a second at least partially arcuate side section extending front a second spaced end of the bottom side to an upper end and connecting the lateral sides to form a pan enclosure; and at least one tray formed at the upper end of one arcuate side section.

2. The pan of claim 1 including a tray formed at the upper end of each side section.

3. The pan of claim 1 wherein the upper end of at least one side section extends outwardly to form a hand grip.

4. The pan of claim 1 wherein the lateral sides are formed with a draft angle between the first and second lateral sides to permit stacking of multiple pans.

5. The pan of claim 1 including a circumferential rib at the top edge of a pan for reinforcement of the pan.

6. A pan for collection of fluid from the axle and hub of a vehicle said hub having a circular rim with a circumferential, substantially horizontal flange, said pan comprising, in combination:

a first lateral side;

a second lateral side spaced from the first side; and

Wherein at least one lateral side has an arcuate upper side margin;

a third connecting side connecting the first and second lateral sides to form a pan enclosure, said third side having an arcuate undersurface section for engaging the flange to support the pan under a hub and axle, and further including a flat bottom section for balanced support of the pan on a flat surface, said third connecting side further including a first upper end and a second upper end, at least one of said upper ends comprising a tray for holding an article.

7. The pan of claim 6 wherein the connecting side includes a first upper end and a second upper end, said upper ends each extending outwardly to define a hand grip.

8. The pan of claim 7 further including a circumferential rim for structural reinforcement of the pan.

9. A pan for collection of fluid from the axle and hub of a vehicle said hub having a circular rim with a circumferential, substantially horizontal flange, said pan comprising, in combination:

a first lateral side;

a second lateral side spaced from the first side; and wherein at least one lateral side has an arcuate upper side margin;

a third side connecting the first and second lateral sides to form a pan enclosure, said third side having a first upper end and second upper end, at least one of said upper ends extending outwardly to form a hand grip, and at least one of said upper ends extending outwardly to form a tray.

10. The pan of claim 9 wherein each of said upper ends extend outwardly to form a hand grip.

11. A pan for collection of fluid from the axle and hub of a vehicle, said hub having a circular rim with a circumferential, substantially horizontal flange, said pan comprising, in combination:

a first lateral side;

a second lateral side spaced from the first side; and

Wherein at least one lateral side has an arcuate upper side margin.

12. The pan of claim 11 wherein the third connecting side comprises a flat bottom and an arcuate section on each side of the flat bottom.

13. The pan of claim 11 wherein the third connecting side comprises a flat bottom and an arcuate section on each side of the flat bottom.

* * * * *

UNITED STATES PATENT AND TRADEMARK OFFICE

CERTIFICATE OF CORRECTION

PATENT NO. : 6,454,121 B1 
DATED : September 24, 2002
INVENTOR(S) : Kurtz et al.

It is certified that error appears in the above-identified patent and that said Letters Patent is hereby corrected as shown below:

Column 4,
Line 49, cancel text beginning with "11. A pan for collection" to and ending "upper side margin" in line 57, and insert the following claim:

-- 11. A pan for collection of fluid from the axle and hub of a vehicle. Said hub having a circular rim with a circumferential, substantially horizontal flange, said pan comprising, In combination:

a first lateral side;

a second lateral side spaced from the first side wherein at least one lateral side has an arcuate upper side margin:

a third connecting side connecting the lateral sides to form a pan enclosure, said third side having a first and a second upper end at least one of said upper ends comprising a tray separate from the pan enclosure. --.

Signed and Sealed this

Sixth Day of June, 2006

JON W. DUDAS
*Director of the United States Patent and Trademark Office*